US007156979B2

(12) United States Patent
Benum et al.

(10) Patent No.: US 7,156,979 B2
(45) Date of Patent: Jan. 2, 2007

(54) THERMAL CRACKING PROCESS USING TUBES, PIPES, AND COILS MADE OF NOVEL STAINLESS STEEL MATRIX

(75) Inventors: Leslie Wilfred Benum, Red Deer (CA); Michael C. Oballa, Cochrane (CA); Sabino Steven Anthony Petrone, Edmonton (CA); Weixing Chen, Edmonton (CA)

(73) Assignee: Nova Chemicals (International) S.A. (CH)

( * ) Notice: Subject to any disclaimer, the term of this patent is extended or adjusted under 35 U.S.C. 154(b) by 286 days.

(21) Appl. No.: 10/955,760

(22) Filed: Sep. 30, 2004

(65) Prior Publication Data

US 2005/0077210 A1 Apr. 14, 2005

Related U.S. Application Data

(62) Division of application No. 09/659,361, filed on Sep. 12, 2000, now Pat. No. 6,824,883.

(51) Int. Cl.
*C10G 9/14* (2006.01)
*C10G 9/12* (2006.01)

(52) U.S. Cl. ..... 208/132; 208/48 R; 208/106; 148/327; 373/111; 420/67

(58) Field of Classification Search ..... 208/48 R, 208/106, 132; 148/327; 373/111; 420/67
See application file for complete search history.

(56) References Cited

U.S. PATENT DOCUMENTS

| | | | | |
|---|---|---|---|---|
| 3,864,093 | A | 2/1975 | Wolfla | 29/195 |
| 4,078,949 | A | 3/1978 | Boggs | 148/6.35 |
| 5,536,338 | A | 7/1996 | Metivier et al. | 148/633 |
| 5,630,887 | A | 5/1997 | Benum | 148/280 |
| 5,693,155 | A * | 12/1997 | Mousseaux et al. | 148/327 |
| 5,944,981 | A * | 8/1999 | Sievert | 208/48 R |

* cited by examiner

*Primary Examiner*—Glenn Caidarola
*Assistant Examiner*—Prem C. Singh
(74) *Attorney, Agent, or Firm*—Kenneth H Johnson

(57) ABSTRACT

A thermal cracking process using tubes, pipes, and coils made of.

An outermost surface covering not less than 55% of stainless steel, said surface having a thickness from 0.1 to 15 microns and being a spinel of the formula $Mn_xCr_{3-x}O_4$ wherein x is from 0.5 to 2 is not prone to coking and is suitable for hydrocarbyl reactions such as furnace tubes for cracking.

9 Claims, 2 Drawing Sheets

Run Length of a Pretreated Versus a Non-Pretreated Tube During Ethane Cracking

Run Length of a Pretreated Versus a Non-Pretreated Tube During Ethane Cracking

THERMAL CRACKING PROCESS USING TUBES, PIPES, AND COILS MADE OF NOVEL STAINLESS STEEL MATRIX

This is a division of application Ser. No. 09/659,361 filed on Sep. 12, 2000, now U.S. Pat. No. 6,824,883.

FIELD OF THE INVENTION

The present invention relates to an outermost surface on steel, particularly stainless steel having a high chromium content. The present invention provides an outermost surface on steels which surface provides enhanced materials protection (e.g. protects the substrate or matrix). The surface reduces coking in applications where the steel is exposed to a hydrocarbon environment at high temperatures. Such stainless steel may be used in a number of applications, particularly in the processing of hydrocarbons and in particular in pyrolysis processes such as the dehydrogenation of alkanes to olefins (e.g. ethane to ethylene); reactor tubes for cracking hydrocarbons; or reactor tubes for steam cracking or reforming.

BACKGROUND OF THE INVENTION

It has been known for some time that the surface composition of a metal alloy may have a significant impact on its utility. It has been known to treat steel to produce an iron oxide layer that is easily removed. It has also been known to treat steel to enhance its wear resistance. The use of stainless steels has heretofore relied upon the protection (e.g. against corrosion and other forms of material degradation) afforded by a chromia surface. As far as Applicants are aware there is not a significant amount of art on treating steels to significantly reduce coking in hydrocarbon processing. There is even less art on the types of surface that reduce coking significantly in hydrocarbon processing.

There has been experimental work related to the nuclear industry that spinels similar to the present invention can be generated on stainless surfaces. However, these spinels are thermo-mechanically unstable and tend to delaminate. This is a limitation which tends to teach against using such surfaces commercially. These surfaces have been evaluated for use in the nuclear industry but to Applicants' knowledge have never been commercially used.

In the petrochemical industry due to its thermo-mechanical limitations spinels similar to the present invention are believed to be overall less protective than chromia. It is also believed from a coke make perspective spinels similar to the present invention are not considered to be more catalytically inert than chromia. Due to these teachings, to Applicants' knowledge, such spinels have not been produced for use in the petrochemical industry.

U.S. Pat. No. 3,864,093 issued Feb. 4, 1975 to Wolfla (assigned to Union Carbide Corporation) teaches applying a coating of various metal oxides to a steel substrate. The oxides are incorporated into a matrix comprising at least 40 weight % of a metal selected from the group consisting of iron, cobalt and nickel and from 10 to 40 weight % of aluminum, silicon and chromium. The balance of the matrix is one or more conventional metals used to impart mechanical strength and/or corrosion resistance. The oxides may be simple or complex such as spinels. The patent teaches that the oxides should not be present in the matrix in a volume fraction greater than about 50%, otherwise the surface has insufficient ductility, impact resistance and resistance to thermal fatigue. The outermost surface of the present invention covers at least 55% of the stainless steel (e.g. at least 55% of the outer or outermost surface of the stainless steel has the composition of the present invention).

U.S. Pat. No. 5,536,338 issued Jul. 16,1996 to Metivier et al. (assigned to Ascometal S.A.) teaches annealing carbon steels rich in chromium and manganese in an oxygen rich environment. The treatment results in a surface scale layer of iron oxides slightly enriched in chromium. This layer can easily be removed by pickling. Interestingly, there is a third sub-scale layer produced which is composed of spinels of Fe, Cr and Mn. This is opposite to the subject matter of the present patent application.

U.S. Pat. No. 4,078,949 issued Mar. 14, 1978 to Boggs et al. (assigned to U.S. Steel) is similar to U.S. Pat. No. 5,536,338 in that the final surface sought to be produced is an iron based spinel. This surface is easily subject to pickling and removing of slivers, scabs and other surface defects. Again this art teaches away from the subject matter of the present invention.

U.S. Pat. No. 5,630,887 issued May 20, 1997 to Benum et al. (assigned to Novacor Chemicals Ltd. (now NOVA Chemicals Corporation)) teaches the treatment of stainless steel to produce a surface layer having a total thickness from about 20 to 45 microns, comprising from 15 to 25 weight % of manganese and from about 60 to 75 weight % of chromium. Clearly the patent requires the presence of both manganese and chromium in the surface layer but does not teach a spinel. The present invention requires a surface predominantly of a spinel of the formula $Mn_xCr_{3-x}O_4$ wherein x is from 0.5 to 2. The reference fails to teach the surface composition of the present invention.

The present invention seeks to provide a surface having extreme inertness (relative to coke make) and sufficient thermo-mechanical stability to be useful in commercial applications. The present invention also seeks to provide an outermost surface on steels which surface provides enhanced materials protection (e.g. protects the substrate or matrix).

SUMMARY OF THE INVENTION

Figure 1:
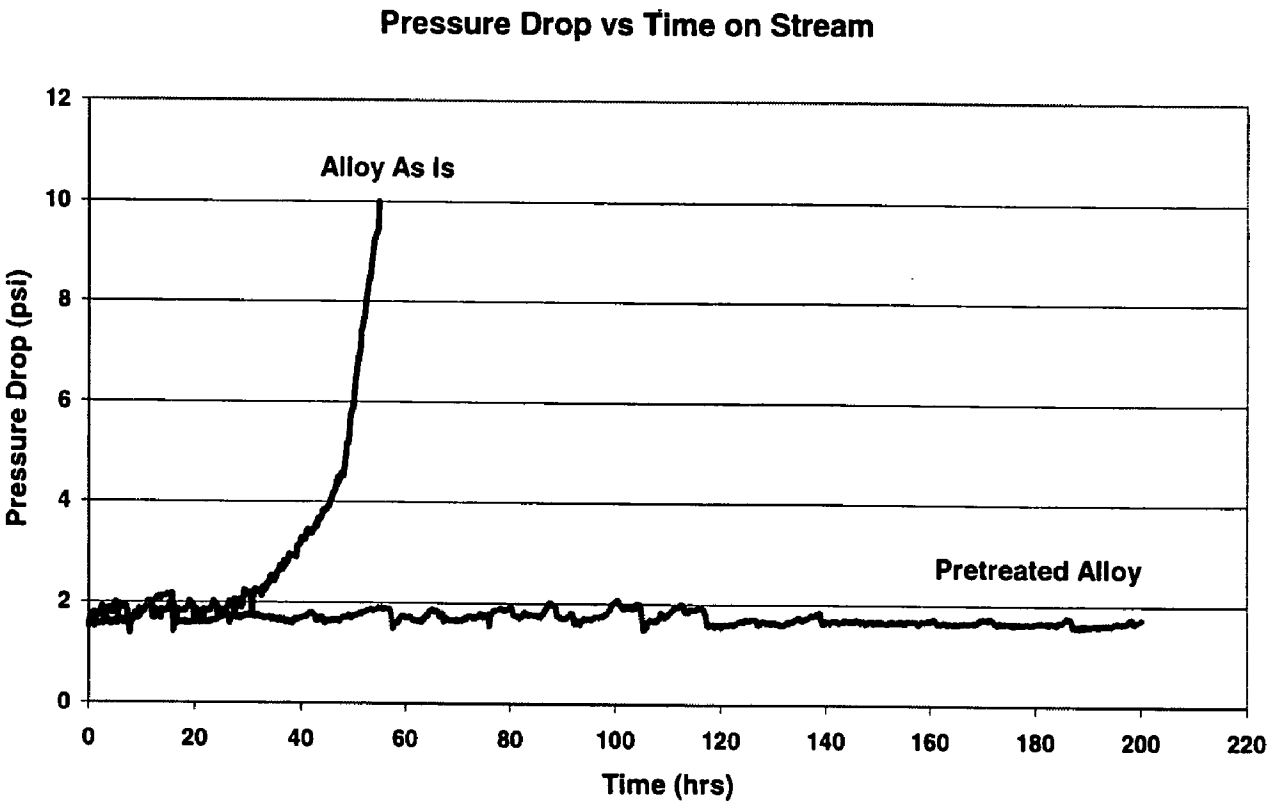
FIG. 1 shows a profile of pressure drop against operating time for furnace tubes having a surface in accordance with the present invention and conventional tubes as tested in NOVA Chemicals Technical Scale Pyrolysis Unit.

The present invention provides an outermost surface covering not less than 55% of stainless steel (e.g. a stainless steel substrate), said surface having a thickness from 0.1 to 15 microns and substantially comprising a spinel of the formula $Mn_xCr_{3-x}O_4$ wherein x is from 0.5 to 2.

The present invention further provides stainless steel pipe or tubes (e.g. furnace tubes for the cracking of hydrocarbons and in particular the cracking of ethane, propane, butane, naphtha, and gas oils, or mixtures thereof), heat exchangers having an inner surface or a cooling surface and reactors having an internal surface as described above.

DETAILED DESCRIPTION

In the ethylene furnace industry the furnace tubes may be a single tube or tubes and fittings welded together to form a coil.

The stainless steel, preferably heat resistant stainless steel which may be used in accordance with the present invention typically comprises from 13 to 50, preferably from 20 to 38 weight % of chromium and at least 0.2 weight %, up to 3 weight % preferably not more than 2 weight % of Mn. The stainless steel may further comprise from 20 to 50, preferably from 25 to 48, weight % of Ni; from 0.3 to 2, preferably 0.5 to 1.5 weight % of Si; less than 5, typically less than 3, weight % of titanium, niobium and all other trace metals; and carbon in an amount of less than 0.75 weight %. The balance of the stainless steel is substantially iron.

The outermost surface of the stainless steel has a thickness from 0.1 to 15, preferably from 0.1 to 10, microns and is a spinel of the formula $Mn_xCr_{3-x}O_4$ wherein x is from 0.5 to 2. Generally, this outermost spinel surface covers not less than 55%, preferably not less than 60%, most preferably not less than 80%, desirably not less than 95% of the stainless steel.

The spinel has the formula $Mn_xCr_{3-x}O_4$ wherein x is from 0.5 to 2. X may be from 0.8 to 1.2. Most preferably X is 1 and the spinel has the formula $MnCr_2O_4$.

One method of producing the surface of the present invention is by treating the shaped stainless steel (i.e. part). The stainless steel is treated in the presence of an atmosphere having an oxygen partial pressure less than $10^{-18}$ atmospheres comprising:

i) increasing the temperature of the stainless steel from ambient temperature at a rate of 20° C. to 100° C. per hour until the stainless steel is at a temperature from 550° C. to 750° C.;

ii) holding the stainless steel at a temperature from 550° C. to 750° C. for from 2 to 40 hours;

iii) increasing the temperature of the stainless steel at a rate of 20° C. to 100° C. per hour until the stainless steel is at a temperature from 800° C. to 1100° C.; and iv) holding the stainless steel at a temperature from 800° C. to 1100° C. for from 5 to 50 hours.

The heat treatment may be characterized as a heat/soak-heat/soak process. The stainless steel part is heated at a specified rate to a hold or "soak" temperature for a specified period of time and then heated at a specified rate to a final soak temperature for a specified period of time.

In the process the heating rate in steps (i) and (ii) may be from 20° C. to 100° C. per hour, preferably from 60° C. to 100° C. per hour. The first "soak" treatment is at a temperature 550° C. to 750° C. for from 2 to 40 hours, preferably at a temperature from 600° C. to 700° C. for from 4 to 10 hours. The second "soak" treatment is at a temperature from 800° C. to 1100° C. for from 5 to 50 hours, preferably at a temperature from 800° C. to 1000° C. for from 20 to 40 hours.

The atmosphere for the treatment of the steel should be a very low oxidizing atmosphere. Such an atmosphere generally has an oxygen partial pressure of $10^{-18}$ atmospheres or less, preferably $10^{-20}$ atmospheres or less. In one embodiment the atmosphere may consist essentially of 0.5 to 1.5 weight % of steam, from 10 to 99.5, preferably from 10 to 25 weight % of one or more gases selected from the group consisting of hydrogen, CO and $CO_2$ and from 0 to 89.5, preferably from 73.5 to 89.5 weight % of an inert gas. The inert gas may be selected from the group consisting of nitrogen, argon and helium. Other atmospheres which provide a low oxidizing environment will be apparent to those skilled in the art.

Other methods for providing the surface of the present invention will be apparent to those skilled in the art. For example the stainless steel could be treated with an appropriate coating process for example as disclosed in U.S. Pat. No. 3,864,093.

It is known that there tends to be a scale layer intermediate the surface of a treated stainless steel and the matrix. For example this is briefly discussed in U.S. Pat. No. 5,536,338. Without wishing to be bound by theory it is believed that there may be one or more scale layer(s) intermediate the outermost surface of the present invention and the stainless steel matrix. Also without being bound by theory it is believed that one of these layers may be rich in chromium oxides most likely chromia.

The stainless steel is manufactured into a part and then the appropriate surface is treated. The steel may be forged, rolled or cast. In one embodiment of the invention the steel is in the form of pipes or tubes. The tubes have an internal surface in accordance with the present invention. These tubes may be used in petrochemical processes such as cracking of hydrocarbons and in particular the cracking of ethane, propane, butane, naphtha, and gas oil, or mixtures thereof. The stainless steel may be in the form of a reactor or vessel having an interior surface in accordance with the present invention. The stainless steel may be in the form of a heat exchanger in which either or both of the internal and/or external surfaces are in accordance with the present invention. Such heat exchangers may be used to control the enthalpy of a fluid passing in or over the heat exchanger.

A particularly useful application for the surfaces of the present invention is in furnace tubes or pipes used for the cracking of alkanes (e.g. ethane, propane, butane, naphtha, and gas oil, or mixtures thereof) to olefins (e.g. ethylene, propylene, butene, etc.). Generally in such an operation a feedstock (e.g. ethane) is fed in a gaseous form to a tube, pipe or coil typically having an outside diameter ranging from 1.5 to 8 inches (e.g. typical outside diameters are 2 inches about 5 cm; 3 inches about 7.6 cm; 3.5 inches about 8.9 cm; 6 inches about 15.2 cm and 7 inches about 17.8 cm). The tube or pipe runs through a furnace generally maintained at a temperature from about 900° C. to 1050° C. and the outlet gas generally has a temperature from about 800° C. to 900° C. As the feedstock passes through the furnace it releases hydrogen (and other byproducts) and becomes unsaturated (e.g. ethylene). The typical operating conditions such as temperature, pressure and flow rates for such processes are well known to those skilled in the art.

The present invention will now be illustrated by the following non-limiting examples. For both examples 1 and 2 the analyzed outermost surface using SEM/EDX was typically less than 5 microns thick. Identification and assignment of the phase structure of the outermost surface species was carried out using a combination of X-ray diffraction and X-ray Photoelectron Spectroscopy (XPS). The X-ray diffraction unit was a Siemens 5000 model with DIFFRAC AT software and access to a powder diffraction file database (JCPDS-PDF). The XPS unit was a Surface Science Laboratories Model SSX-100. In the examples unless otherwise stated parts is parts by weight (e.g. grams) and percent is weight percent.

EXAMPLES

Example 1

A steam-cracker-pyrolysis reactor uses coils made of alloys whose composition by Energy Dispersive X-ray (EDX) Analysis (normalized for the metals content only) is given in the table below as New. Iron, nickel, and compounds thereof, that are present in reasonable amounts are known to be catalytically active in making coke—so termed "catalytic coke". The Ni and Fe content in the alloy especially on the surface is therefore indicative of the propensity of that alloy to catalyze coke make. Coupons were cut from the alloy and pretreated with hydrogen and steam as described above. The surface of the coupons was analyzed and the results are shown in Table 1. The iron and nickel content of the surface of the coupon was greatly reduced while the content of chromium and manganese was largely increased as shown below in Table 1.

TABLE 1

| Metal Type | New Untreated Alloy 1 Surface Metals Content (wt %) | Treated Alloy 1 Surface Metals Content (wt %) |
|---|---|---|
| Si | | |
| Cr | 33.4 | 65.9 |
| Mn | 1.1 | 30.2 |
| Fe | 18.5 | 1.7 |
| Ni | 43.6 | 1.3 |
| Nb | | |

Example 2

Coupons from another alloy of a different composition than the one in Example 1 was also treated in the presence of hydrogen and steam as described above. The surface of the coupon was analyzed and the results are shown in Table 2. It is important to note is that it is possible through the application of the process disclosed above to create a surface that is deficient in iron and nickel.

TABLE 2

| Metal Type | New Untreated Alloy 2 Surface Metals Content (wt %) | Treated Alloy 2 Surface Metals Content (wt %) |
|---|---|---|
| Si | | |
| Cr | 45.1 | 89.0 |
| Mn | 1.1 | 10.1 |
| Fe | 7.9 | 0.2 |
| Ni | 44.1 | 0.7 |
| Nb | | |

Example 3

After the coupon tests were completed, a tube having an inner surface treated in accordance with the present invention was used in experimental cracking runs in a Technical Scale Pyrolysis Unit. In this example, the feed was ethane. Steam cracking of ethane was carried out under the following conditions:

| | |
|---|---|
| Dilution Steam Ratio = | 0.3 wt/wt |
| Ethane Flow Rate = | 3 kg/hr |
| Pressure = | 20 psig |
| Coil Outlet Gas Temperature = | 800° C. |

The unit uses a 2 inch coil (outside diameter) with some internal modification to give a flow that is outside the laminar flow regime. The run length is normally 50 to 60 hours before the tube needs to be cleaned of coke. A tube having a treated internal surface in accordance with the present invention ran continuously for 200 hours as per FIG. 1, after which the unit was shut down not because of coke pluggage of the coil or pressure drop, but because the tube had passed the expected double the run length. Coke make in the coil was completely reduced and it was expected that it would have run for a much longer period (i.e. the pressure drop is flat-lined).

Example 4

Commercial plant results were as good as and sometimes better than the Technical Scale Pyrolysis Unit run lengths. The commercial plant results runs were based on the same range of alloys as described herein. The conditions at the start of a run are typically a coil inlet pressure of 55 psi and an outlet pressure or quench exchanger inlet pressure of 15 psi. The end of a run is reached when the coil inlet pressure has increased to about 77 psi. Typically the quench exchanger inlet pressure will be at about 20 psi at end of run. The end of run is therefore when so much coke has deposited in the coil that the run has to be stopped and the coke is removed through decoking with steam and air. The tubes/coils having a surface as described herein have demonstrated run lengths of at least 100 days and many have exceeded one year. Example furnace coils having an internal surface in accordance with the present invention: H-141 in ethylene plant #2 at Joffre, Alberta had a run time of 413 days without a decoke; H-148 ran for 153 days without decoking; and H-142 ran for 409 days without a decoke. A normal run time at similar rates/conversions/etc. of furnace tubes that do not have the internal surface of the present invention is about 40 days.

Figure 2:
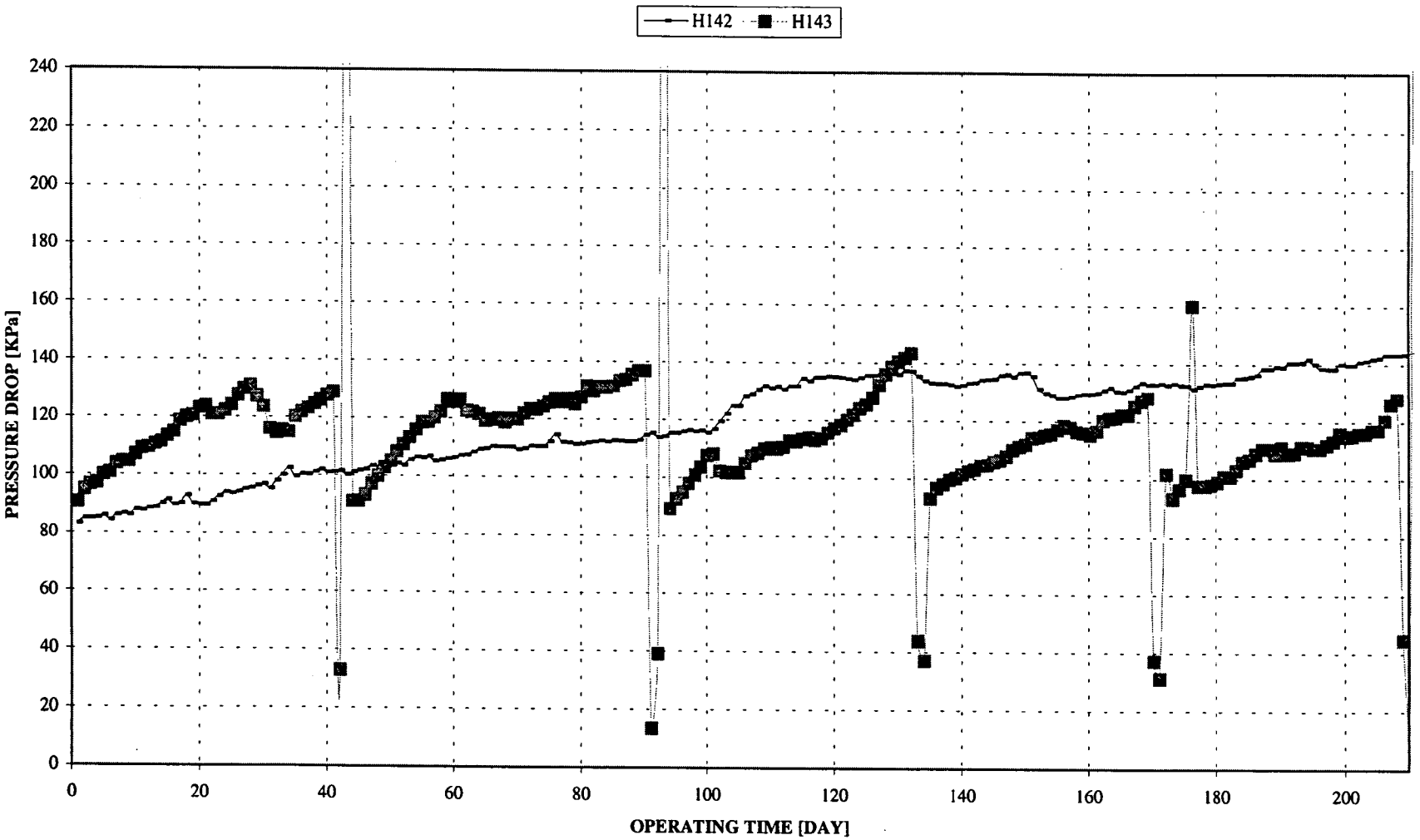
FIG. 2 shows a profile of pressure drop against operating time for furnaces using coils having a surface in accordance with the present invention and conventional coils as demonstrated in commercial ethylene crackers.

FIG. 2 shows the run profiles of furnace tubes having an internal surface in accordance with the present invention versus a coil from a commercial unit without the surface of the present invention and demonstrates the inherent advantages of this invention. The breaks in the conventional runs occurred when the coils had to be decoked. The coils having an internal surface in accordance with the present invention did not have to be decoked.

What is claimed is:

1. A process for the thermal cracking of a hydrocarbon comprising passing said hydrocarbon at elevated temperatures through stainless steel tubes, pipes, or coils having an inner surface, said inner surface having an outermost surface covering not less than 60% of stainless steel comprising from 20 to 50 weight % of Ni, from 13 to 50 weight % of Cr, 0.2 to 3.0 weight % Mn, from 0.3 to 2.0 weight % of Si and less than 5 weight % of titanium, niobium and all other trace metals, and carbon in an amount less than 0.75 weight %, said surface having a resistance to coke formation when the stainless steel is exposed to a hydrocarbon environment at high temperatures and having a thickness from 0.1 to 10 microns and substantially comprising a spinel of the formula $MnCr_2O_4$.

2. A process for the thermal cracking of a hydrocarbon according to claim 1, wherein said outermost surface covers not less than 80% of stainless steel.

3. A process for the thermal cracking of a hydrocarbon according to claim 2, wherein said outermost surface covers not less than 95% of stainless steel.

4. A process for altering the enthalpy of a fluid comprising passing the fluid through a heat exchanger having an inner surface, said inner surface having an outermost surface covering not less than 60% of stainless steel comprising from 20 to 50 weight % of Ni, from 13 to 50 weight % of Cr, 0.2 to 3.0 weight % Mn, from 0.3 to 2.0 weight % of Si and less than 5 weight % of titanium, niobium and all other trace metals, and carbon in an amount less than 0.75 weight %, said surface having a resistance to coke formation when the stainless steel is exposed to a hydrocarbon environment at high temperatures and having a thickness from 0.1 to 10 microns and substantially comprising a spinel of the formula $MnCr_2O_4$.

5. A process for altering the enthalpy of a fluid according to claim 4, wherein said outermost surface covers not less than 80% of stainless steel.

6. A process for altering the enthalpy of a fluid according to claim 5, wherein said outermost surface covers not less than 95% of stainless steel.

7. A process for altering the enthalpy of a fluid comprising passing the fluid through a heat exchanger having a cooling surface, said cooling surface having an outermost surface covering not less than 60% of stainless steel comprising from 20 to 50 weight % of Ni, from 13 to 50 weight % of Cr, 0.2 to 3.0 weight % Mn, from 0.3 to 2.0 weight % of Si and less than 5 weight % of titanium, niobium and all other trace metals, and carbon in an amount less than 0.75 weight %, said surface having a resistance to coke formation when the stainless steel is exposed to a hydrocarbon environment at high temperatures and having a thickness from 0.1 to 10 microns and substantially comprising a spinel of the formula $MnCr_2O_4$.

8. A process for altering the enthalpy of a fluid according to claim 7, wherein said outermost surface covers not less than 80% of stainless steel.

9. A process for altering the enthalpy of a fluid according to claim 8, wherein said outermost surface covers not less than 95% of stainless steel.

* * * * *